US011805353B2

(12) United States Patent
Yamamoto et al.

(10) Patent No.: US 11,805,353 B2
(45) Date of Patent: Oct. 31, 2023

(54) HEADPHONE

(71) Applicant: SONY GROUP CORPORATION, Tokyo (JP)

(72) Inventors: Atsushi Yamamoto, Tokyo (JP); Daizen Kobayashi, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 102 days.

(21) Appl. No.: 17/310,981

(22) PCT Filed: Feb. 3, 2020

(86) PCT No.: PCT/JP2020/003866
§ 371 (c)(1),
(2) Date: Sep. 2, 2021

(87) PCT Pub. No.: WO2020/189054
PCT Pub. Date: Sep. 24, 2020

(65) Prior Publication Data

US 2022/0086558 A1 Mar. 17, 2022

(30) Foreign Application Priority Data

Mar. 18, 2019 (JP) ..... 2019-049250

(51) Int. Cl.
*H04R 1/02* (2006.01)
*H04R 1/10* (2006.01)
*H04R 1/08* (2006.01)

(52) U.S. Cl.
CPC ..... *H04R 1/1075* (2013.01); *H04R 1/08* (2013.01); *H04R 1/1008* (2013.01); *H04R 1/02* (2013.01); *H04R 1/105* (2013.01); *H04R 2460/11* (2013.01)

(58) Field of Classification Search
CPC . H04R 1/00; H04R 1/02; H04R 1/021; H04R 1/025; H04R 1/026; H04R 1/028;
(Continued)

(56) References Cited

U.S. PATENT DOCUMENTS

2017/0041706 A1* 2/2017 Evans ..... H04R 1/086
2017/0280227 A1* 9/2017 Huang ..... H04R 9/06
(Continued)

FOREIGN PATENT DOCUMENTS

CN 205902020 U * 1/2017
DE 2006249 A1 8/1970
(Continued)

OTHER PUBLICATIONS

International Search Report and Written Opinion of PCT Application No. PCT/JP2020/003866, dated Mar. 10, 2020, 08 pages of ISRWO.

*Primary Examiner* — Thang V Tran
(74) *Attorney, Agent, or Firm* — CHIP LAW GROUP

(57) ABSTRACT

The present invention provides a headphone, comprising: a casing in which a hole portion leading to the inside and outside is formed; a diaphragm; a support for supporting the diaphragm; and an air flow path for air taken from the outside of the casing to the inside through the hole portion, wherein a plurality of the air flow paths are provided, and extension directions of axes set on an open end surface on one side of the air flow paths intersect.

14 Claims, 12 Drawing Sheets

(58) Field of Classification Search
CPC ..... H04R 1/08; H04R 1/10; H04R 1/1008; H04R 1/105; H04R 1/1058; H04R 1/1075; H04R 2460/11
See application file for complete search history.

(56) References Cited

U.S. PATENT DOCUMENTS

| | | | | |
|---|---|---|---|---|
| 2018/0091883 | A1 | 3/2018 | Howes | |
| 2018/0206013 | A1 | 7/2018 | Imamura | |
| 2018/0295449 | A1* | 10/2018 | Morgan | H04R 1/105 |
| 2019/0172440 | A1 | 6/2019 | Ashizawa | |
| 2021/0385577 | A1* | 12/2021 | Badger | H04R 5/02 |

FOREIGN PATENT DOCUMENTS

| | | | |
|---|---|---|---|
| JP | 2009-218687 | A | 9/2009 |
| JP | 2011-087048 | A | 4/2011 |
| WO | 2017/208397 | A1 | 12/2017 |

* cited by examiner

HEADPHONE

CROSS REFERENCE TO RELATED APPLICATIONS

This application is a U.S. National Phase of International Patent

Application No. PCT/JP2020/003866 filed on Feb. 3, 2020, which claims priority benefit of Japanese Patent Application No. JP 2019-049250 filed in the Japan Patent Office on Mar. 18, 2019. Each of the above-referenced applications is hereby incorporated herein by reference in its entirety.

TECHNICAL FIELD

The present disclosure relates to a headphone.

BACKGROUND ART

A headphone having a casing and provided with a hole portion for sucking and discharging air passing through the inside and outside of the casing has been known (see, for example, PTL 1). Providing the hole portion eases the changes in pressure inside the casing and prevents a diaphragm from coming into contact with other parts.

CITATION LIST

Patent Literature

[PTL 1] JP 2009-218687A

SUMMARY

Technical Problem

However, the air taken in through the hole portion may turn into noise such as wind noise, deteriorating the sound quality of a reproduced sound reproduced from the headphone. In the configuration of the headphone according to PTL 1, in order to prevent the noise from deteriorating the sound quality, providing a microphone for canceling the noise is essential.

One of the objects of the present disclosure is to provide a headphone configured to effectively reduce noise caused by air entering and exiting a hole portion.

Solution to Problem

The present disclosure is a headphone comprising, for example:

a casing in which a hole portion leading to the inside and outside is formed;

a diaphragm;

a support for supporting the diaphragm;

and an air flow path functioning as a flow path for air taken from the outside of the casing to the inside through the hole portion, wherein a plurality of the air flow paths are provided, and extension directions of axes set on open ends on one side of the air flow paths intersect.

The present disclosure is a headphone comprising, for example:

a casing in which a hole portion leading to the inside and outside is formed;

a diaphragm;

a support for supporting the diaphragm;

and an air flow path functioning as a flow path for air taken from the outside of the casing to the inside through the hole portion, wherein at least a pair of the air flow paths is provided, and open ends on one side of the respective air flow paths face each other.

DESCRIPTION OF EMBODIMENTS

Embodiments and the like of the present disclosure are described hereinafter with reference to the drawings. The descriptions provided in the following order.

EMBODIMENTS

<Modifications>

Embodiments and the like described hereinafter are preferred specific examples of the present disclosure, and the content of the present disclosure is not limited to such embodiments and the like.

EMBODIMENTS

Structural Example of Headphone (Basic Structural Example of Headphone)

Figure 1:
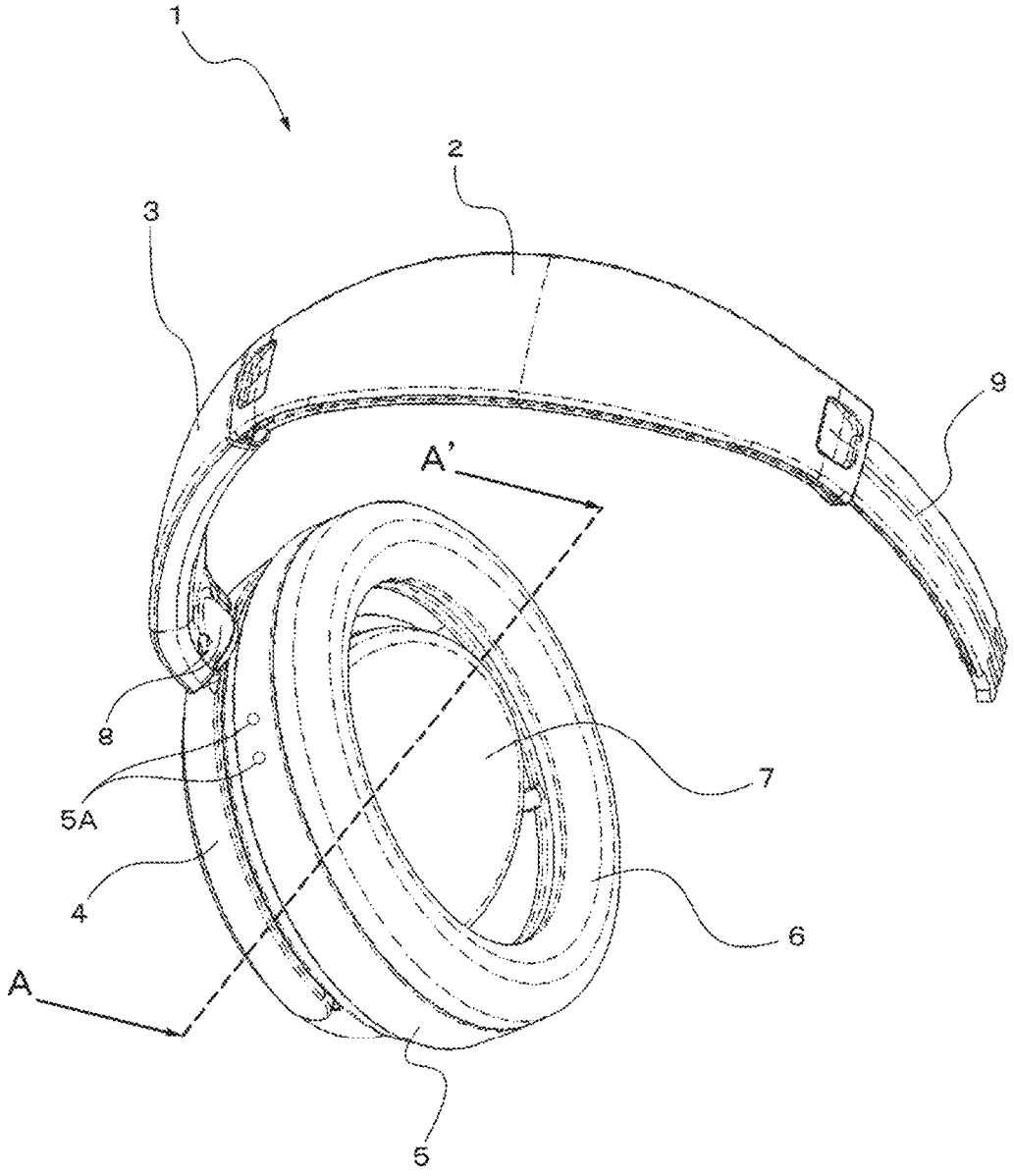
FIG. 1 is a diagram for explaining a configuration of the appearance of a headphone according to an embodiment.

FIG. 1 is a diagram for explaining a configuration of the appearance of a headphone (headphone 1) according to an embodiment of the present disclosure. Note that FIG. 1 omits the illustration of some members for convenience of explanation. A housing and an ear pad on a L (Left) channel side are configured in the same manner as those on a R (Right) channel side.

As shown in FIG. 1, the headphone 1 is composed of, for example, a headband 2, a slider 3, a hanger 4, a housing 5, an ear pad 6, and a driver unit portion 7 provided in the housing 5.

The headband 2 is formed so as to curve along the head of a wearer, and is configured to support the entire headphone 1 by coming into contact with the top of the head of the wearer wearing the headphone 1. The headband 2 is made of a synthetic resin such as plastic, metal, or the like, and is flexible by having predetermined rigidity and elasticity. Therefore, when wearing the headphone 1, the housing 5 and the ear pad 6 can be pressed against a side of the head of the wearer to keep the worn state of the headphone 1. It should be noted that a rubber or the like may be provided as a cushioning material on a part of an inner surface of the headband 2 that comes into contact with the top of the head of the wearer. Moreover, a hinge may be provided so that the headphone 1 can be folded at the center thereof when carrying the headphone 1.

The slider 3 is provided at each end of the headband 2. The hanger 4 is attached to a joint portion 8 provided at one end of the slider 3. The slider 3 is configured to be slidable along a guide member 9 fixed to each end of the headband 2 and having an axis coinciding with a central axis of the headband 2. Sliding the slider 3 along the guide member 9 can move the hanger 4 away from or close to the headband 2. When wearing the headphone 1, the housing 5 and the ear pad 6 can be positioned so as to face the ear of the wearer by adjusting the position of the slider 3 in accordance with the size of the head of the wearer and the distance between the ear and the top of the head of the wearer. As a result, the wearer can achieve a fit corresponding to his/her physical characteristics and taste. On the other hand, when not using the headphone 1, a storage space can be saved by contracting the slider 3.

The hanger 4 is provided at a tip of the slider 3 with the joint portion 8 therebetween and is configured to rotatably support the housing 5. The joint portion 8 may hold the hanger 4 in a fixed manner or may hold the hanger 4 so that the hanger 4 can rotate about the axes of the headband 2 and the guide member 9.

The hanger 4 rotatably supports the housing 5 by, for example, axially supporting the housing 5 with support pins (not shown) protruding inward from a pair of tips. In this manner, when wearing the headphone 1, since the direction of the housing 5 changes in accordance with the shape of the ear of the wearer and the side of the head of the wearer, the housing 5 is placed facing the ear of the wearer while fitting to the shape of the side of the head of the wearer.

The housing 5 functioning as the casing has a storage space therein, and houses the driver unit portion 7 or the like functioning as an audio output unit that converts an electric signal into a sound wave and outputs the sound wave. The housing 5 is made of, for example, a synthetic resin such as plastic. A hole portion 5A leading to the inside and outside of the housing 5 is formed in the housing 5. The position where the hole portion 5A is formed and the number of hole portions 5A can be changed as appropriate. Further, a surface of the housing 5 opposite to the side provided with the ear pad 6 may be in the form of a mesh composed of a large number of hole portions. Note that FIGS. 2 and 3 omit the illustration of the hole portion 5A.

The ear pad 6 is provided on a surface of the housing 5 that face the side of the head of the wearer. The ear pad 6 functions as a cushioning member between the housing 5 and the side of the head of the wearer by being placed between the housing 5 and the side of the head of the wearer. In other words, when wearing the headphone 1, the ear pad 6 prevents the housing 5 from directly coming into contact with the ear of the wearer and the side of the head of the wearer and causing discomfort or pain to the wearer, the housing 5 being made of a hard material that is not deformed easily.

Also, depending on the material of the ear pad 6, the ear pad 6 can suppress sound omission and serves to improve sound quality by improving reproducibility of a low range. The ear pad 6 also serves to prevent a sound output from the driver unit portion 7 from leaking to the outside. The ear pad 6 also functions to block external noise so that the sound from the driver unit portion 7 can be heard easily. The driver unit portion 7 is movable with respect to the housing 5, regardless of whether the headphone 1 is worn or not.

In addition, the headphone 1 may be provided with a cable for conducting an electric signal formed by appropriately converting a sound. The cable has a left channel conductor L, a right channel conductor R, a ground wire G, and the like inserted thereto, and is configured to transmit a sound signal from a sound reproduction apparatus (not shown) such as a portable music player or a television receiver to the headphone 1. One end of the cable is connected to the driver unit portion 7 housed in one of a pair of housings 5. A plug (not shown) is provided on the other end of the cable. By connecting the plug to the sound reproduction apparatus, the headphone 1 is connected to the sound reproduction apparatus.

In order to drive the driver unit portion 7 in the other housing 5 to which the cable is not connected, a connection cable (not shown) is provided between the one housing 5 to which the cable is connected and the other housing 5 to which the cable is not connected. This connection cable is connected to the cable or the driver unit portion 7 of the housing 5 to which the cable is connected, and is connected to the driver unit portion 7 of the other housing 5 by being inserted through the hanger 4, the guide member 9, and the headband 2. The connection cable transmits the sound signal to the driver unit portion 7 of the other housing 5 to which the cable is not connected. However, two cables may be connected to the left and right housings 5 to supply sound signals to the driver unit portions 7 of both the left and right housings 5 respectively.

(Example of Internal Structure of Housing)

Figure 2:
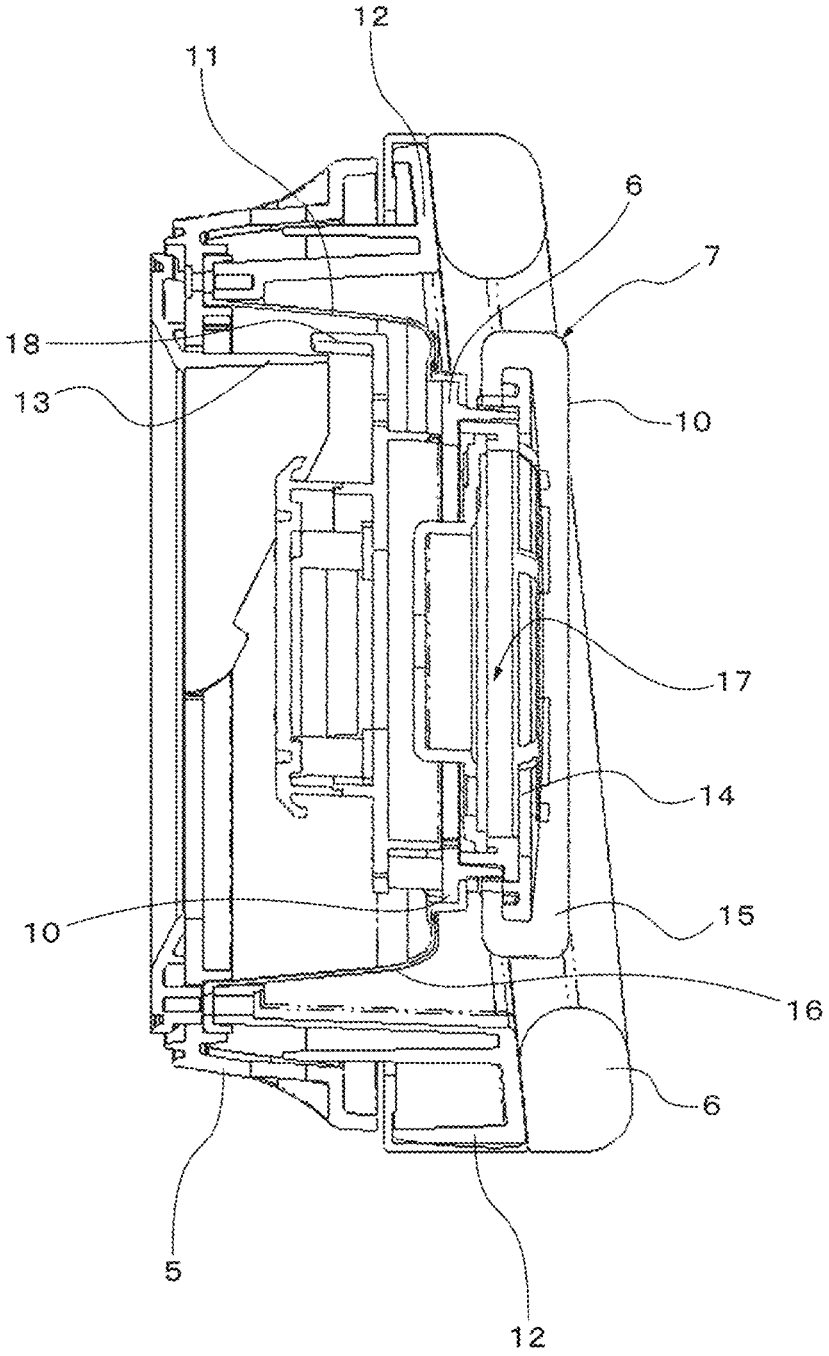
FIG. 2 is a diagram for explaining an example of an internal configuration of the headphone according to the embodiment.
Figure 3:
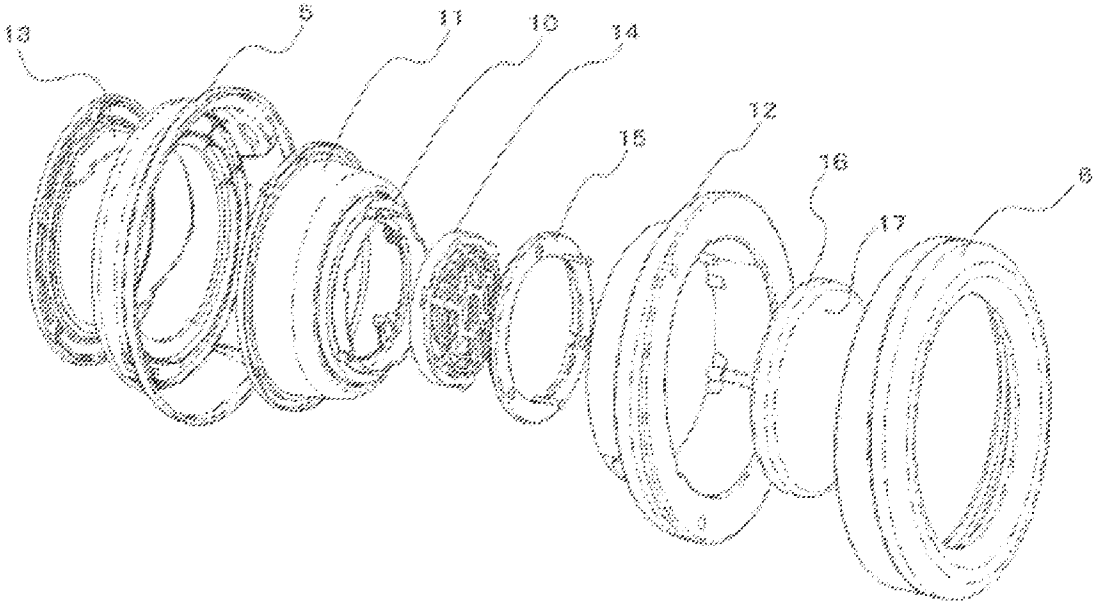
FIG. 3 is a diagram for explaining an example of an internal configuration of the headphone according to the embodiment.

An internal structure of the housing of the headphone 1 according to the embodiment is described next with reference to FIGS. 2 and 3. FIG. 2 is a cross-sectional diagram of the housing 5, the ear pad 6, and the driver unit portion 7 of the headphone 1 shown in FIG. 1, taken along line A-A. FIG. 3 is an exploded perspective view of the housing 5, the ear pad 6, and the driver unit portion 7.

As shown in FIG. 2, the housing 5 and the driver unit portion 7 are connected to each other via a unit holder 10 and a film-like elastic body 11. Also, the housing 5 and the ear pad 6 are connected to each other via a front plate 12.

As shown in FIG. 3, the housing 5 is a substantially cylindrical body having both ends open. The driver unit portion 7, the unit holder 10, and the film-like elastic body 11 are housed inside the housing 5. A stopper 13 is inserted into the housing 5 from the outside via the opening on one end of the housing 5.

The driver unit portion 7 has a driver unit 14, a unit cover 15, and a pinna pad 16. The driver unit 14 is a member where a signal transmitted from the cable (not shown) is converted into a sound to create a sound. Specifically, the driver unit 14 has a diaphragm and a magnetic circuit that displaces the diaphragm. The sounds heard by a user of the headphone according to the present disclosure are output from the driver unit 14. An example of a detailed configuration of the driver unit 14 is described hereinafter.

The unit cover 15 is a protective member for the driver unit 14, and the unit cover 15 may not be provided. The pinna pad 16 is a member that covers the driver unit 14 and the unit cover 15. Since the unit cover 15 and the pinna pad 16 are attached so as to cover the driver unit 14, it is preferred that the unit cover 15 and the pinna pad 16 be formed from a material and a structure that do not block or shield a sound output from the driver unit 14. Further, since the pinna pad 16 is a member with which the pinna of the wearer directly comes into contact, it is preferred that a contact surface 17, which is a surface portion of the pinna pad 16, be at least a cushioning member. The pinna pad 16 can be formed of, for example, the same material as the ear pad 6, urethane, an appropriate foamable resin, or the like.

The ear pad 6 is an annular body and is attached to the front plate 12 by an appropriate method. As shown in FIG. 3, the front plate 12 is a substantially cylindrical body having both ends open. A rib formed so as to project outward is provided at the opening on one end of the front plate 12, so that the ear pad 6 can be attached to this rib.

The unit holder 10 and the film-like elastic body 11 are integrally formed, as shown in FIG. 3. The unit holder 10 is a part that is fixed to the driver unit portion 7 by adhesion, welding, fitting, screwing, or the like, and is preferably harder than the film-like elastic body 11 described hereinafter. The film-like elastic body 11 is a substantially cylindrical body, and is made of a soft, flexible material. An opening at one end of the film-like elastic body 11 and the unit holder 10 are integrally joined, and an opening at the other end of the film-like elastic body 11 is pressed and fixed by the front plate 12. The front plate 12 may be adhered using an adhesive or the like after pressing the opening of the other end of the film-like elastic body 11. The unit holder 10 and the film-like elastic body 11 may be formed by integrally joining with different materials by means of two-color molding or the like. Note that, in the headphone 1, the unit holder and the film-like elastic body do not need to be integrally formed by two-color molding or the like; the members may be fixed to each other by means of adhesion, welding, or the like.

The material of the unit holder 10 may be any material capable of holding the driver unit portion 7 in a fixed manner, and examples of such material include polyethylene (PE), polyethylene terephthalate (PET), polyvinyl chloride (PVC), polyvinylidene chloride (PVDC), polypropylene (PP), polyamide (PA), polycarbonate (PC), polystyrene (PS), polyester, ABS resin, AS resin, and acrylic resin.

The material of the film-like elastic body 11 is not particularly limited as long as the material is capable of providing urging force for bringing the driver unit portion 7 to the original position thereof even if the film-like elastic body 11 fixed to the driver unit portion 7 is deformed by a movement of the driver unit portion 7 and does not change the nature thereof in a temperature environment and a humidity environment under normal use conditions of the headphone, and examples of such material include elastomers and silicone rubbers. The urging force of the film-like elastic body 11 may be at a level that does not press the pinna excessively, does not cause pain even in contact with the pinna for a long time, or is smaller than a lateral pressure of the headband of the headphone.

The driver unit portion 7 is disposed so as to be closer to the pinna of the wearer, that is, to project toward the pinna of the wearer and the side of the head of the wearer, as compared with the conventional headphone.

The unit holder 10 is provided with a regulation portion 18 that extends so as to partially protrude toward the housing 5, that is, the back of the headphone. Note that the regulation portion 18 is a member for restricting the movement of the driver unit portion 7 at an appropriate position.

Examples of Configuration of Driver Unit (Examples of Configuration of Entire Driver Unit)

Figure 4:
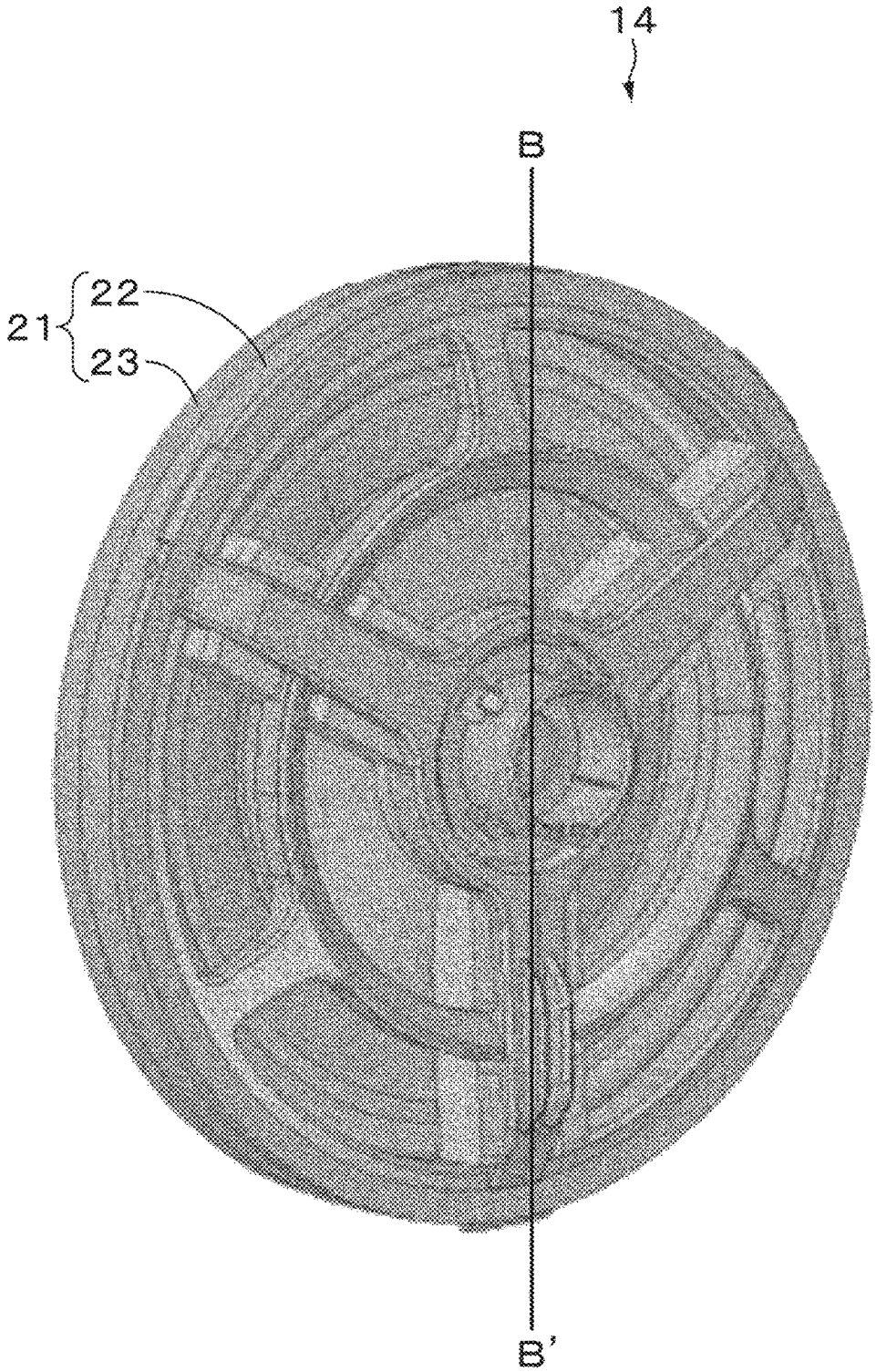
FIG. 4 is a diagram for explaining an example of a configuration of a driver unit according to the embodiment.
Figure 5:
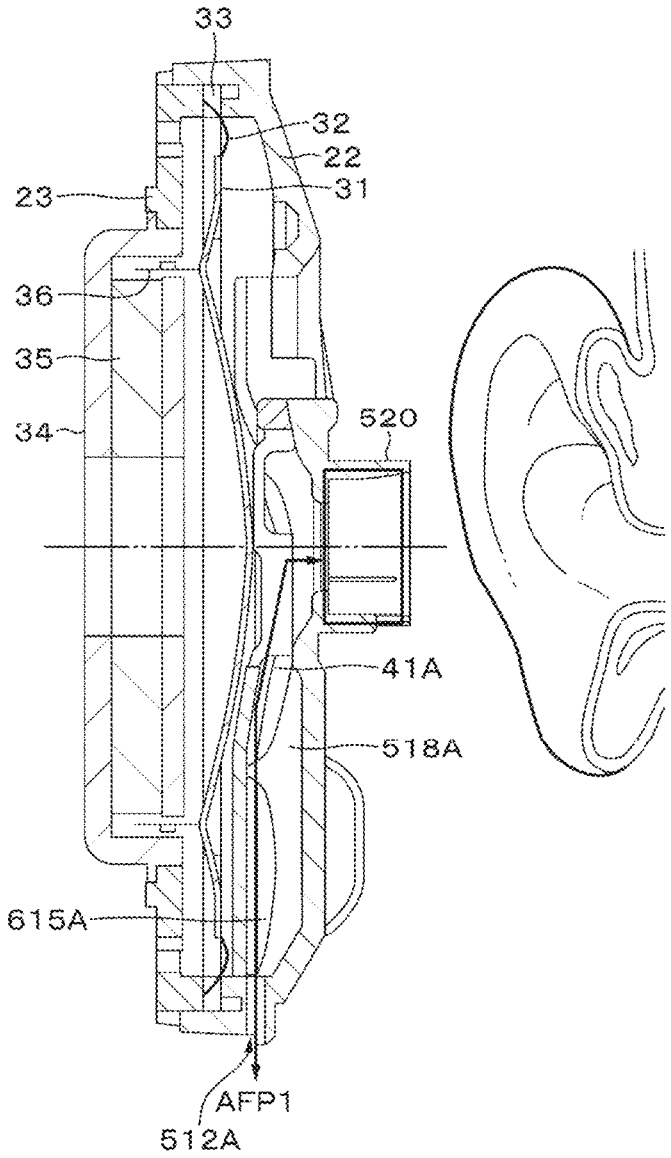
FIG. 5 is a diagram for explaining an example of a configuration of a driver unit according to the embodiment.

Next, examples of a configuration of the driver unit 14 according to the embodiment are described next with reference to FIGS. 4, 5, 6A, 6B, 7, and 8. FIG. 4 is a perspective view showing an example of an overall configuration of the driver unit 14. FIG. 5 is a cross-sectional diagram of the driver unit 14, taken along line B-B' of FIG. 4. FIG. 5 schematically shows an ear of the user who uses the headphone 1.

As shown in FIG. 4, the driver unit 14 has a support 21. The support 21 also functions as a protective cover that supports the diaphragm and protects the diaphragm. The support 21 according to the present embodiment has a first support 22 and a second support 23 that is engaged with the first support 22 from the side opposite to the pinna. The first support 22 and the second support 23 each have a substantially annular shape.

A circular diaphragm 31 is disposed inside the first support 22 and the second support 23. As shown in FIG. 5, an edge 32, which is a peripheral edge of the diaphragm 31, is sandwiched by peripheral edges of the first support 22 and the second support 23, so that the diaphragm 31 is supported by the support 21. Note, in the present embodiment, that a metal washer 33 is interposed between the peripheral edge of the first support 22 and the peripheral edge of the second support 23, and the edge 32 is sandwiched between the metal washer 33 and the first support 22. The metal washer 33 may be omitted, or a predetermined section of the edge 32 may be adhered or the like.

A yoke 34 is held inside the second support 23. A magnet 35 is attached to the inside of the yoke 34. A voice coil 36 is provided in a gap facing the yoke 34 and the magnet 35, and one end of the voice coil 36 is attached to a predetermined section of the diaphragm 31. For example, a magnetic circuit is formed by a configuration including the yoke 34, the magnet 35, and the voice coil 36.

(Examples of Configuration of First Support, Support Main Body, and Engaging Member)

Figure 6A:
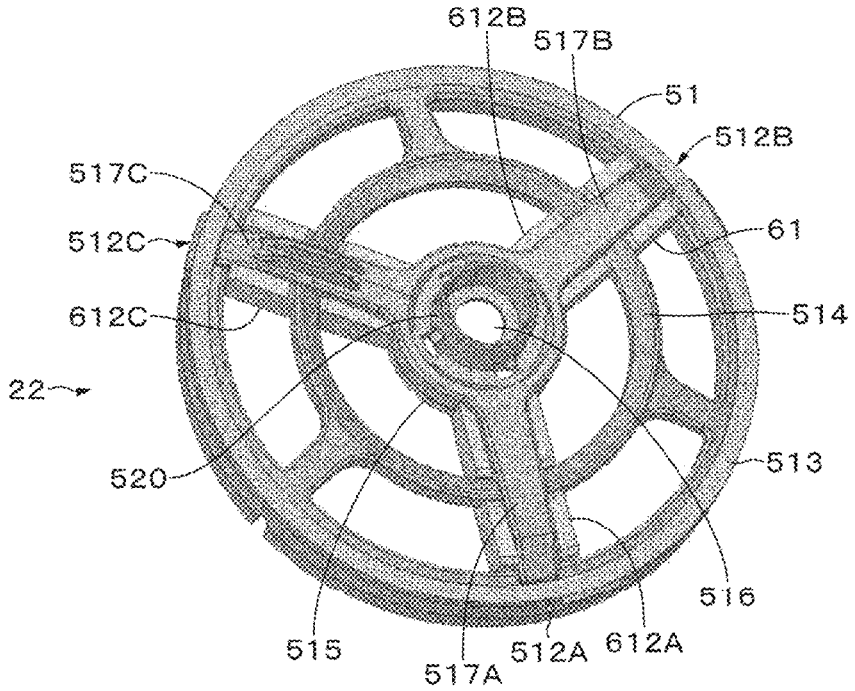
FIGS. 6A and 6B are each a diagram for describing an example of a configuration of a first support according to the embodiment.
Figure 6B:
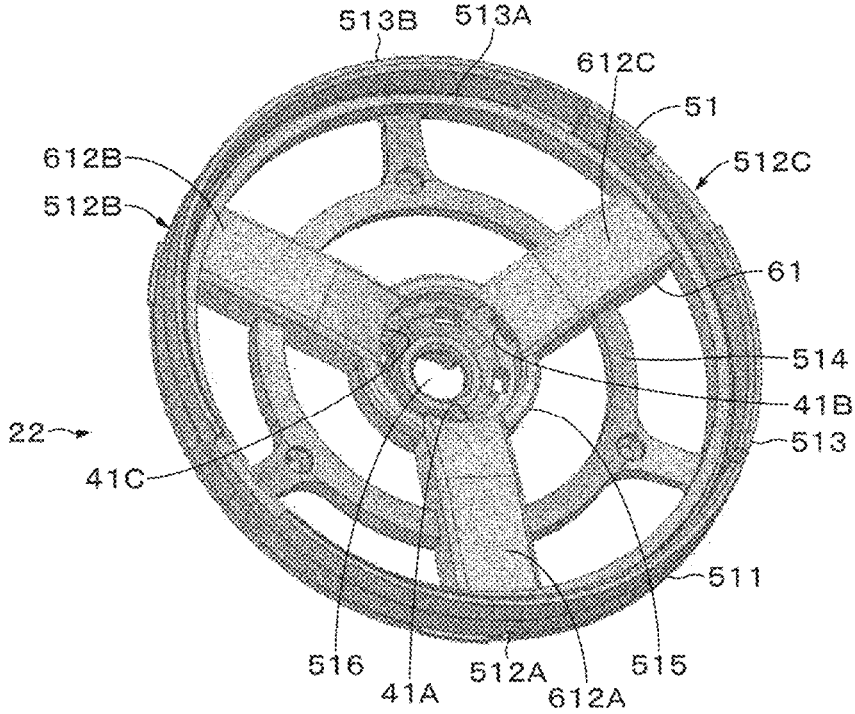

FIGS. 6A and 6B are each a perspective view showing an example of the first support 22, FIG. 6A being a perspective view of the first support 22 as viewed from the pinna side, and FIG. 6B being a perspective view of the first support 22 as viewed from the side opposite to the pinna (external space side). The first support 22 has a support main body 51 and an engaging member 61 that is engaged with a predetermined section of the support main body 51.

Figure 7:
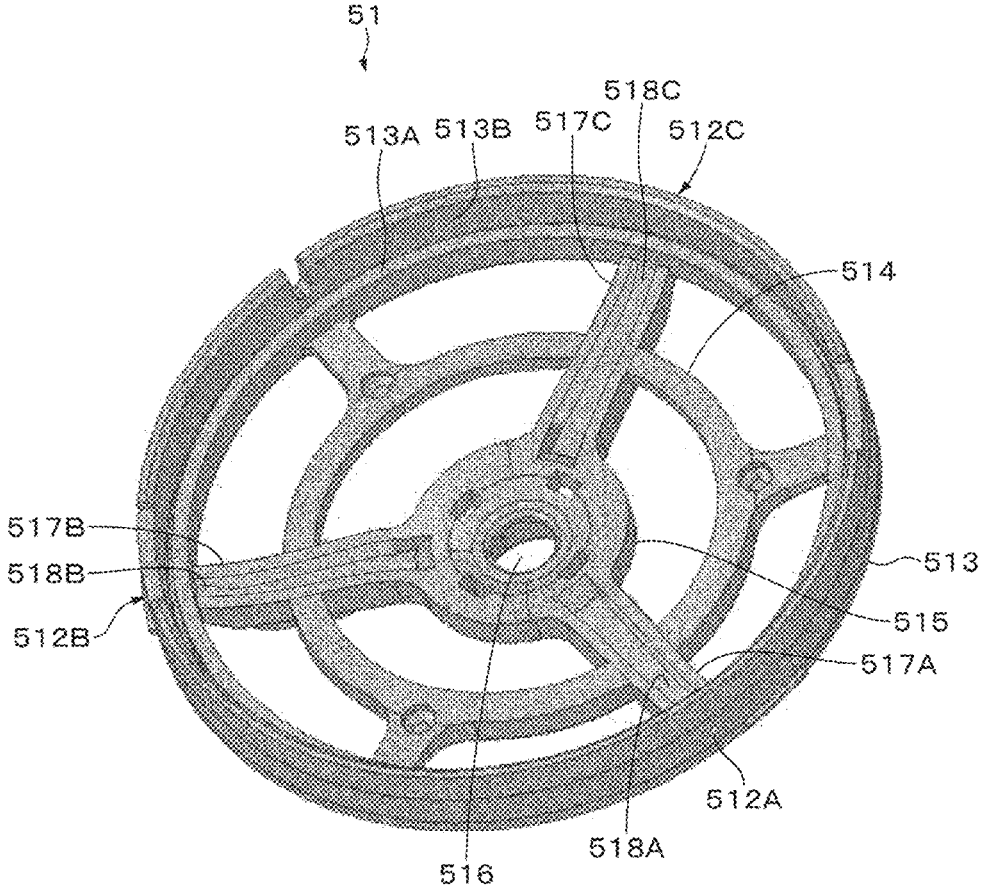
FIG. 7 is a diagram for explaining an example of a configuration of a support main body according to the embodiment.

FIG. 7 is a perspective view showing an example of the support main body 51. An example of a configuration of the support main body 51 is described with reference to FIGS. 6A, 6B, and 7. The support main body 51 has an outer frame portion 513 having an annular shape as a whole, and a circular inner frame portion 514 that is concentric with the outer frame portion 513 and is located inside the outer frame portion 513. The outer frame portion 513 has an annular base portion 513A and a 513B provided upright so as to extend from the base portion 513A toward a part to which the second support 23 is attached. The wall portion 513B includes three hole portions (hole portions 512A, 512B, 512C) provided approximately 120-degree intervals and penetrating the wall portion 513B. When it is not necessary to distinguish between the individual hole portions, the hole portions are appropriately referred to as hole portion 512. The hole portion 512 communicates the inside and outside of the support main body 51 partitioned by the wall portion 513B.

A central portion 515 is provided in the vicinity of a center of the outer frame portion 513 and the inner frame portion 514, and a circular hole portion 516 penetrating the central portion 515 is provided in the middle of the central portion 515. Support arm portions are formed so as to extend radially from the central portion 515 toward the outer frame portion 513 across the inner frame portion 514. In the present embodiment, for example, three support arm portions (support arm portions 517A, 517B, 517C) are formed at approximately 120-degree intervals. In the following description, when it is not necessary to distinguish between the individual support arm portions, the support arm portions are collectively referred to as support arm portions 517 as appropriate. The support arm portions 517 connect the outer frame portion 513, the inner frame portion 514, and the central portion 515.

A first recessed portion 518 is formed in each of the support arm portions 517 (see FIG. 7). Specifically, a first recessed portion 518A is formed in the support arm portion 517A, a first recessed portion 518B is formed in the support arm portion 517B, and a first recessed portion 518C is formed in the support arm portion 517C. A space including the first recessed portion 518A is communicated with the hole portion 512A and with a space outside the support main body 51 via the hole portion 512A. A space including the first recessed portion 518B is communicated with the hole portion 512B and with a space outside the support main body 51 via the hole portion 512B. A space including the first recessed portion 518C is communicated with the hole portion 512C and with a space outside the support main body 51 via the hole portion 512C.

From a peripheral edge of the hole portion 516, a microphone support portion 520 is provided upright toward the pinna side. A noise cancellation microphone (not shown) is supported by the microphone support portion 520. In the present disclosure, the noise cancellation microphone may not be provided, in which case the configuration for the microphone support portion 520 may not be provided.

Figure 8:
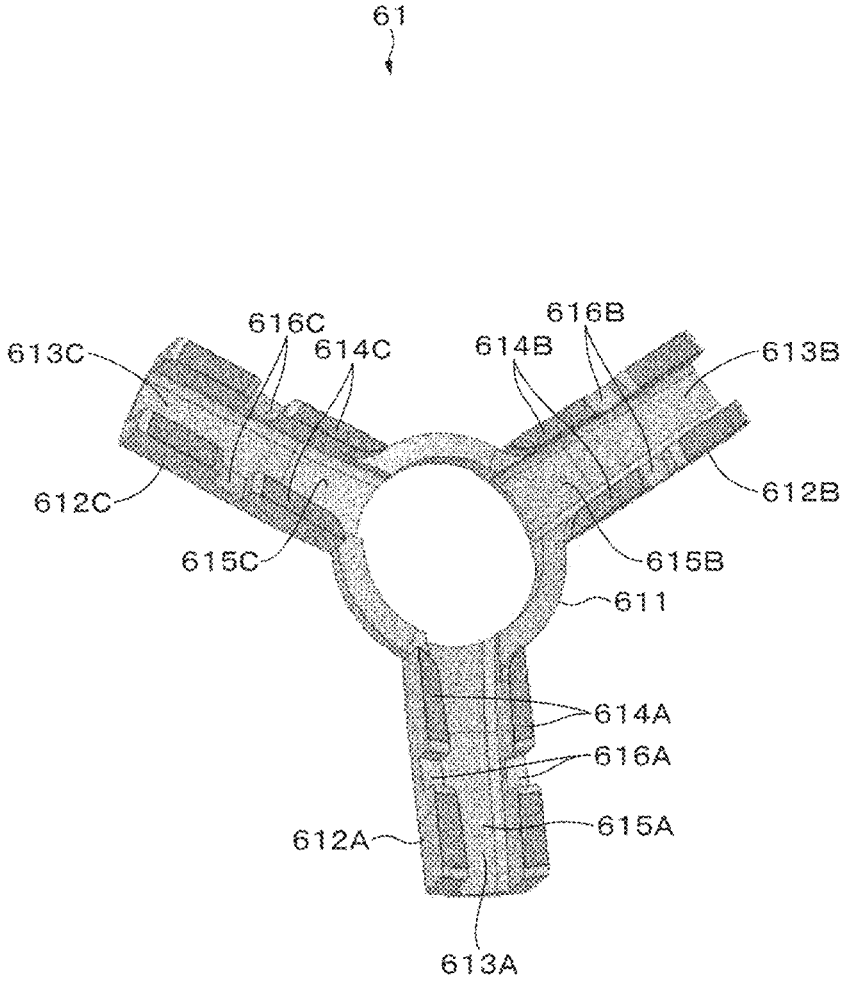
FIG. 8 is a diagram for explaining an example of a configuration of an engaging member according to the embodiment.

FIG. 8 is a perspective view showing an example of the engaging member 61. An example of a configuration of the engaging member 61 is described with reference to FIGS. 6A, 6B, and 8. The engaging member 61 has an annular main body 611. The main body 611 includes three engaging member arm portions extending outward from three sections at approximately 120-degree intervals. Specifically, engaging member arm portions 612A, 612B, and 612C are formed in the main body 611.

The engaging member arm portion 612A has a flat portion 613A on a thin plate extending from the main body 611. A pair of wall portions 614A are formed at both ends of the flat portion 613A in a longitudinal direction. A second recessed portion 615A partitioned by the wall portion 614A is formed in the engaging member arm portion 612A. The width of the second recessed portion 615A in a lateral direction is set to be slightly greater than the width of the support arm portion 517A. A pair of clearance portions 616A is formed in the vicinity of substantially a center of the wall portion 614A in the longitudinal direction. The clearance portions 616A are sections where the inner frame portion 514 is released (sections avoiding the inner frame portion 514) when the engaging member 61 is brought into engagement with the support main body 51.

The engaging member arm portion 612B has a flat portion 613B on a thin plate extending from the main body 611. A pair of wall portions 614B are formed at both ends of the flat portion 613B in a longitudinal direction. A second recessed portion 615B partitioned by the wall portion 614B is formed in the engaging member arm portion 612B. The width of the second recessed portion 615B in a lateral direction is set to be slightly greater than the width of the support arm portion 517B. A pair of clearance portions 616B is formed in the vicinity of substantially a center of the wall portion 614B in the longitudinal direction. The clearance portions 616B are sections where the inner frame portion 514 is released when the engaging member 61 is brought into engagement with the support main body 51.

The engaging member arm portion 612C has a flat portion 613C on a thin plate extending from the main body 611. A pair of wall portions 614C are formed at both ends of the flat portion 613C in a longitudinal direction. A second recessed portion 615C partitioned by the wall portion 614C is formed in the engaging member arm portion 612C. The width of the second recessed portion 615C in a lateral direction is set to be slightly greater than the width of the support arm portion 517C. A pair of clearance portions 616C is formed in the vicinity of substantially a center of the wall portion 614C in the longitudinal direction. The clearance portions 616C are sections where the inner frame portion 514 is released when the engaging member 61 is brought into engagement with the support main body 51.

The support main body 51 and the engaging member 61 are engaged with each other. For example, as shown in FIGS. 6A and 6B, the support arm portion 517A is fitted into the second recessed portion 615A, the support arm portion 517B is fitted into the second recessed portion 615B, and the support arm portion 517C is fitted into the second recessed portion 615C, thereby integrating the support main body 51 and the engaging member 61. In the present embodiment, the integrated support arm portion 517 and the engaging member arm portion 612 correspond to the arm portions of the support 21.

Integrating the support main body 51 and the engaging member 61 creates a space that includes the first recessed portion 518A and the second recessed portion 615A. An open end on one side of such space is an open end 41A on the central portion 515 side (see FIG. 6B), and the hole portion 512A described above is an open end on the other side. The space including the first recessed portion 518A and the second recessed portion 615A is communicated with, for example, the inside of the housing 5, and functions as an air flow path through which the external air taken in from the hole portion 5A and the hole portion 512A flows toward the open end 41A.

Integrating the support main body 51 and the engaging member 61 creates a space that includes the first recessed portion 518B and the second recessed portion 615B. An open end on one side of such space is an open end 41B on the central portion 515 side (see FIG. 6B), and the hole portion 512B described above is an open end on the other side. The space including the first recessed portion 518B and the second recessed portion 615B is communicated with, for example, the inside of the housing 5, and functions as an air flow path through which the air taken in from the hole portion 5A and the hole portion 512B flows toward the open end 41B.

Integrating the support main body 51 and the engaging member 61 creates a space that includes the first recessed portion 518C and the second recessed portion 615C. An open end on one side of such space is an open end 41C on the central portion 515 side (see FIG. 6B), and the hole portion 512C described above is an open end on the other side. The space including the first recessed portion 518C and the second recessed portion 615C is communicated with, for example, the inside of the housing 5, and functions as an air flow path through which the air taken in from the hole portion 5A and the hole portion 512C flows toward the open end 41C.

In other words, the headphone according to the present embodiment has three air flow paths. FIG. 5 shows an air flow path AFP1 that includes the first recessed portion 518A and the second recessed portion 615A. In the following description, the air flow path including the first recessed portion 518B and the second recessed portion 615B is referred to as an air flow path AFP2, and the air flow path including the first recessed portion 518C and the second recessed portion 615C is referred to as an air flow path AFP3. When it is not necessary to distinguish between the individual air flow paths, the air flow paths are appropriately referred to as air flow path AFP.

As shown in FIG. 5, the open end 41A of the air flow path AFP1 is disposed on the pinna side with reference to the diaphragm 31. The same applies to the open end 41B and the open end 41C.

Examples of Operations of Headphone

Figure 9:
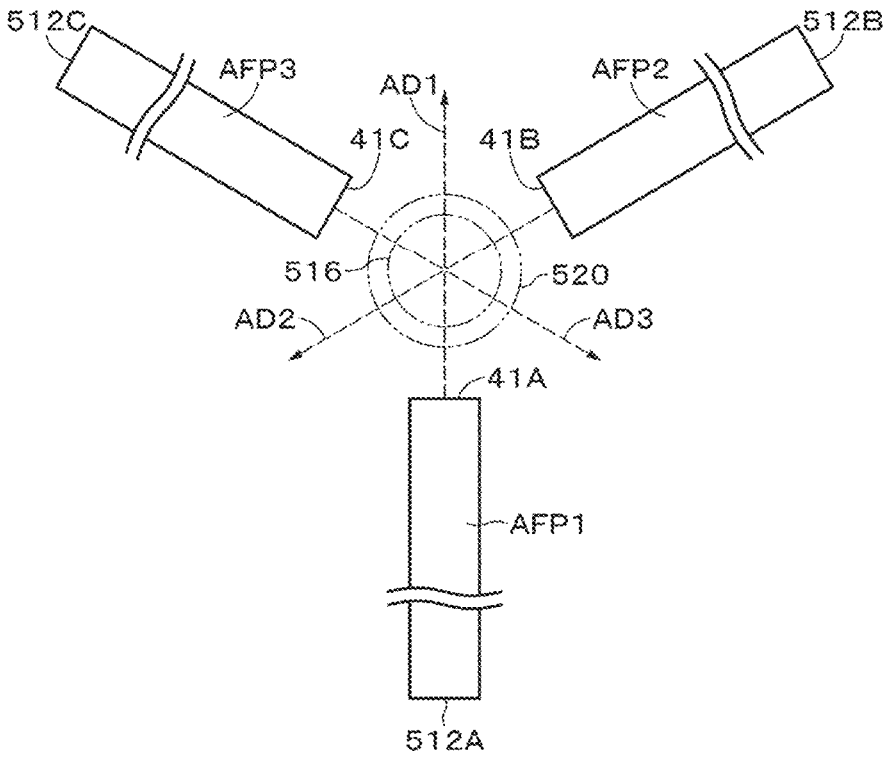
FIG. 9 is a diagram referred to when explaining an operation example of the headphone according to the embodiment.

An operation example of the headphone 1 is described next with reference to FIG. 9. FIG. 9 schematically shows the air flow paths AFP1, AFP2, and AFP3 provided at approximately 120-degree intervals. The air taken into the housing 5 from the hole portion 5A of the housing 5 flows through the air flow path AFP1 via the hole portion 512A and is discharged from the open end 41A of the air flow path AFP1. Moreover, the air taken into the housing 5 from the hole portion 5A of the housing 5 flows through the air flow path AFP2 via the hole portion 512B and is discharged from the open end 41B of the air flow path AFP2. In addition, the air taken into the housing 5 from the hole portion 5A of the housing 5 flows through the air flow path AFP3 via the hole portion 512C and is discharged from the open end 41C of the air flow path AFP2.

In the present embodiment, an extension direction AD1 of an axis that is set virtually with respect to the open end 41A, an extension direction AD2 of an axis that is set virtually with respect to the open end 41B, and an extension direction AD3 of an axis that is set virtually with respect to the open end 41C are configured to intersect. In the present embodiment, the axes that are set on the respective open ends are, for example, axes extending in a direction along the air flow paths through the center of the open ends, and more specifically, axes extending along normal directions of open end surfaces of the open ends. Furthermore, the open end surfaces of the open ends are not necessarily adopted, and cross sections that are set in predetermined sections of the air flow paths may be adopted.

In the present embodiment, the extension directions AD1, AD2, and AD3 of the respective axes intersect at a substantially central position of the support 21, that is, at a substantially central position of the diaphragm 31 supported by the support 21. Specifically, the extension directions AD1, AD2 and AD3 of the respective axes intersect between the hole portion 516 and the microphone support portion 520. Therefore, the microphone is supported in the vicinity of the intersection of the extension directions AD1, AD2 and AD3 of the respective axes.

According to this configuration, the air discharged from the air flow path AFP1 via the open end 41A, the air discharged from the air flow path AFP2 via the open end 41B, and the air discharged from the air flow path AFP3 via the open end 41C collide with each other. In general, the impact of headphone noise (sound pressure) on the headphone is defined by two factors: the speed of gas (fluid) and the vorticity in which the gas is agitated. According to the present embodiment, the speed and vorticity of the air can be reduced by the collision of the air discharged from each air flow path AFP. Therefore, the noise of the headphone 1 can be reduced.

Also, by the configuration in which the extension directions AD1, AD2 and AD3 of the respective axes intersect at the substantially central position of the support 21, the distance between the air flow paths AFP1, AFP2 and AFP3 can be increased, and the speed and vorticity of the air can be reduced effectively.

According to the present embodiment, since the noise on the headphone 1 can be reduced as described above, the noise cancellation microphone may not be provided, and even the microphone support portion 520 that supports the microphone may not be provided. Furthermore, since the air flow paths can be formed by diverting an existing component having the microphone support portion and appropriately adding a necessary configuration, the configuration of the present embodiment in which the headphone 1 includes the microphone support portion 520 may be used.

Note that the microphone supported by the microphone support portion 520 is disposed inside a microphone pinna. In a case where the open ends 41A, 41B and 41C functioning as the air discharge holes are separated from the position of the microphone, a phase difference occurs between an actual noise source and control of the microphone, deteriorating the noise canceling function. Therefore, the occurrence of the phase difference can be suppressed by providing the pinna by a section where the air collides with each other and providing the open ends 41 of the air flow path AFP at a position close to the microphone.

<Modifications>

Although the embodiments of the present disclosure have been specifically described above, the details of the present disclosure are not limited to these embodiments, and various modifications based on the technical idea of the present disclosure can be made. In the following description, the illustration of the configuration of the headphone is simplified as appropriate.

Figure 10A:
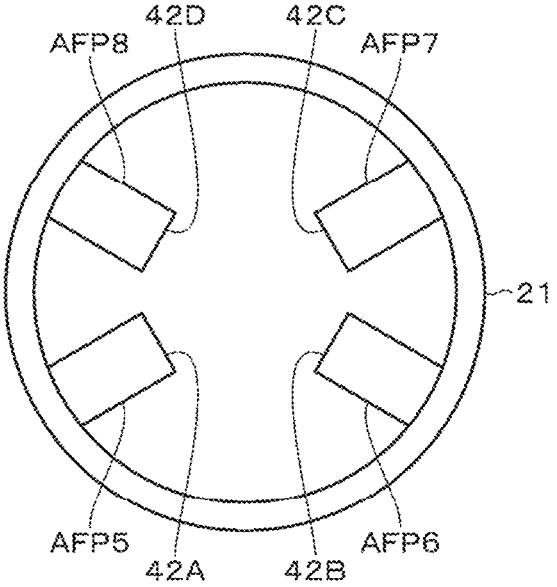
FIGS. 10A and 10B are each a diagram for explaining a modification.

The headphone may have an even number of air flow paths AFP. For example, as shown in FIG. 10A, the headphone may have air flow paths AFPS, AFP6, AFP7 and AFP8. Open ends of paired air flow paths are arranged so as to face each other. For example, an open end 42A of the air flow path AFPS and an open end 42C of the air flow path AFP7 are arranged so as to face each other. An open end 42B of the air flow path AFP6 and an open end 42D of the air flow path AFP8 are arranged so as to face each other. In such configuration as well, the air discharged from the respective open ends can collide with each other, effectively reducing the speed and vorticity of the air.

Figure 10B:
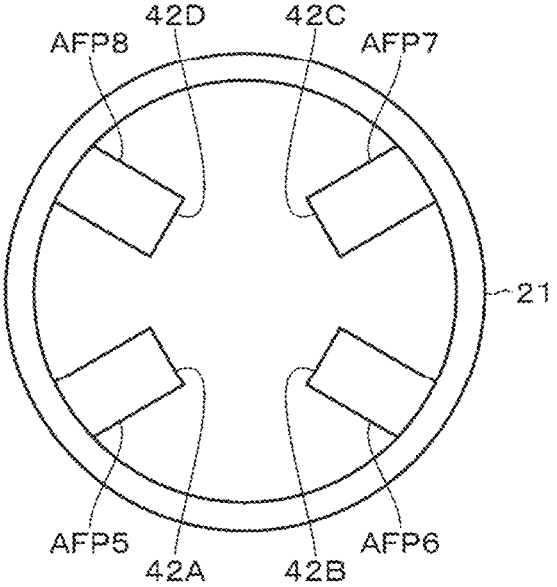

Although it is preferred that the whole surfaces of the open ends face each other, the open ends may face each other in a slightly shifted fashion, as show in FIG. 10B. In other words, the open ends facing each other in this example means that the open ends face each other in a state where the discharged air collides with each other to the extent that noise can be reduced.

Figure 11:
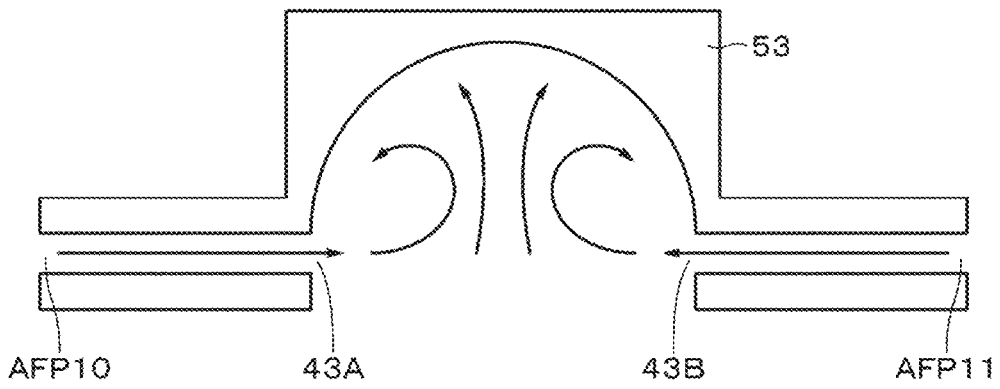
FIG. 11 is a diagram for explaining a modification.

The headphone may be configured into a semi-closed space that facilitates convection of the air discharged from the open ends. For example, as shown in FIG. 11, a chamber 53 is provided at a section located at a tip of an open end 43A of an air flow path AFP10 and a tip of an open end 43B of an air flow path AFP11. The chamber 53 is shaped so as to enable easy convection of the air discharged from each open end, and has, for example, a dome shape (hemispherical shape). Since the flow velocity and vorticity of the air can be reduced by such a configuration, noise can be reduced. Note that the noise cancellation microphone may be supported at an appropriate position outside the chamber 53, and the chamber 53 may function as the microphone support portion. The shape of the chamber 53 is not limited to the dome shape, but may be a square shape or the like.

Figure 12:
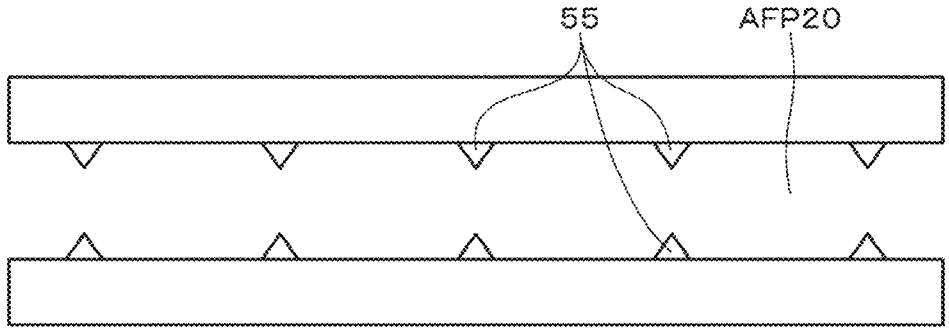
FIG. 12 is a diagram for explaining a modification.

As shown in FIG. 12, protrusions 55 may be provided on a wall portion around an air flow path AFP20. The locations where the protrusions 55 are provided, the shape of the protrusions 55, the number of protrusions 55, and the like can be set appropriately. The protrusions 55 are in the shape of, for example, a turbulator. The protrusions 55 may be provided on the entire wall portion around the air flow path AFP20, or may be provided on a part of the wall portion around the air flow path AFP20. By providing the protrusions 55, the flow velocity of air can be reduced. Furthermore, by providing the protrusions 55, the vortex can be subdivided and thereby the vorticity can be reduced. As a result, noise can be reduced.

Figure 13:
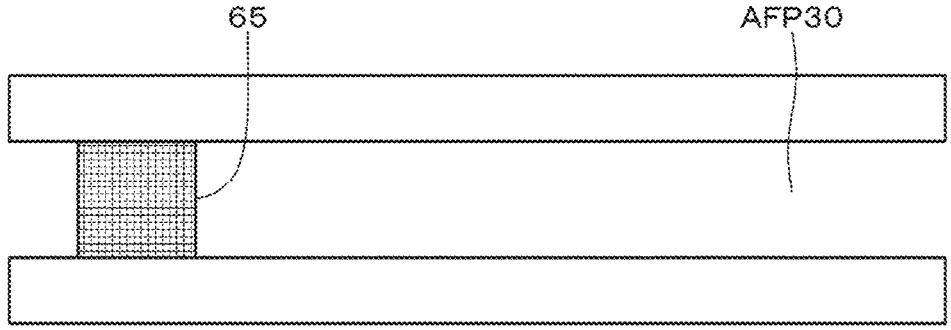
FIG. 13 is a diagram for explaining a modification.

As shown in FIG. 13, a porous body 65 having a large number of hole portions may be provided in an air flow path AFP30 for the purpose of obtaining rectification. A sponge or the like can be employed as the porous body 65. A plurality of the porous bodies 65 may be provided in the air flow path AFP30. The position where the porous body 65 is provided can be an appropriate position such as the vicinity of the open end. By providing the porous body 65, the flow velocity of the air can be reduced and the vorticity can be reduced. Therefore, noise can be reduced.

Figure 14:
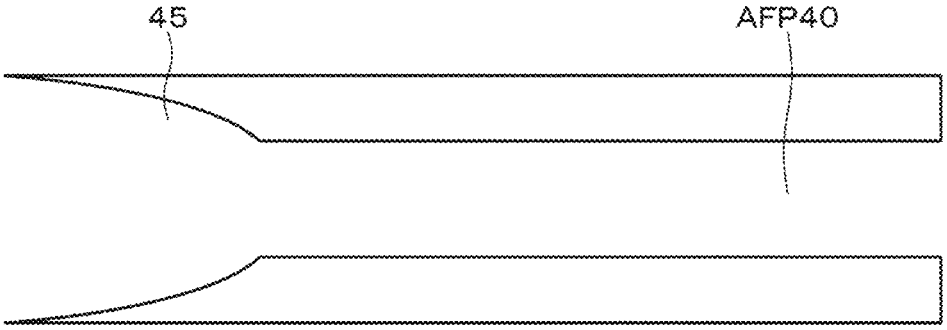
FIG. 14 is a diagram for explaining a modification.

As shown in FIG. 14, an air flow path AFP40 on an open end 45 side may be treated into a shape that reduces the air flow or the vorticity. For example, the air flow path AFP40 on the open end 45 side may be shaped so as to become wide toward the open end 45. With such a shape, the flow velocity of the air can be reduced and the vorticity can be reduced. Therefore, noise can be reduced.

Although the costs may increase, the air flow paths may be formed by using dedicated components in place of the existing components used thus far. Also, the air flow paths may be formed by making the support arm portions hollow without using the engaging member. The shapes of the air flow paths, the open ends, and the like can be changed appropriately according to the shapes of the first recessed portion and the second recessed portion.

Audio signals may be supplied wirelessly to the headphone. In other words, the present disclosure can also be applied to wireless type headphones. The present disclosure can also be applied to earphones.

The configurations, methods, processes, shapes, materials, numerical values, and the like provided in the embodiments described above are merely examples; different configurations, methods, processes, shapes, materials, numerical values, and the like may be used as necessary. The embodiments and modifications described above can be combined as appropriate.

The present disclosure can also adopt the following configurations.

(1)

A headphone, comprising:

a casing in which a hole portion leading to the inside and outside is formed;

a diaphragm;

a support for supporting the diaphragm; and an air flow path for air taken from the outside of the casing to the inside through the hole portion, wherein a plurality of the air flow paths are provided, and extension directions of axes set on open ends on one side of the air flow paths intersect.

(2)

The headphone according to (1), wherein the extension directions of the axes intersect at a substantially central position of the support.

(3)

The headphone according to (1) or (2), wherein the open ends on the one side of the air flow paths are arranged on a pinna side with reference to the diaphragm.

(4)

The headphone according to any one of (1) to (3), wherein the support includes a plurality of arm portions in a direction from a center of the support toward an outer edge of the same, and the air flow paths are formed in the arm portions.

(5)

The headphone according to (4), wherein the arm portions each have a configuration in which a support arm portion of the support and a predetermined engaging member are engaged with each other, and each of the air flow paths is formed by a first recessed portion formed in the support arm portion and a second recessed portion formed in the engaging member.

(6)

The headphone according to any one of (1) to (5), further comprising a microphone supported by the support, wherein the microphone is supported in the vicinity of a section where the extension directions of the axes intersect.

(7)

The headphone according to (6), wherein the support includes a microphone support portion that supports the microphone, the microphone support portion having a semi-closed space formed therein.

(8)

The headphone according to any one of (1) to (7), wherein at least a part of a wall portion of each of the air flow paths is provided with a protrusion.

(9)

The headphone according to any one of (1) to (8), wherein the air flow paths are each provided with a porous body.

(10)

The headphone according to any one of (1) to (9), wherein the open ends on the one side of the air flow paths are shaped so as to become wide toward the open ends.

(11)

A headphone, comprising:

a casing in which a hole portion leading to the inside and outside is formed;

a diaphragm;

a support for supporting the diaphragm; and an air flow path for air taken from the outside of the casing to the inside through the hole portion, wherein at least a pair of the air flow paths is provided, and open ends on one side of the respective air flow paths face each other.

(12)

The headphone according to (11), wherein the open end on the one side of each of the air flow paths is disposed on a pinna side with reference to the diaphragm.

(13)

The headphone according to (11) or (12), wherein the support includes a plurality of arm portions in a direction from a center of the support toward an outer edge of the same, and the air flow paths are formed in the arm portions.

(14)

The headphone according to (13), wherein the arm portions each have a configuration in which a support arm portion of the support and a predetermined engaging member are engaged with each other, and each of the air flow paths is formed by a first recessed portion formed in the support arm portion and a second recessed portion formed in the engaging member.

(15)

The headphone according to any one of (11) to (14), wherein the support includes a microphone support portion that supports a microphone, the microphone support portion having a dome-shaped space formed therein.

(16)

The headphone according to any one of (11) to (15), wherein at least a part of a wall portion of each of the air flow paths is provided with a protrusion.

(17)

The headphone according to any one of (11) to (16), wherein the air flow paths are each provided with a porous body.

(18)

The headphone according to any one of (11) to (17), wherein the open ends on the one side of the air flow paths are shaped so as to become wide toward the open ends.

REFERENCE SIGNS LIST

1 Headphone
5 Housing
5A Hole portion
21 Support
22 First support
23 Second support
31 Diaphragm
41 Open end
51 Support main body
53 Chamber
55 Protrusion
61 Engaging member
65 Porous body
512 Hole portion
517 Support arm portion
518 First recessed portion
520 Microphone support portion
615A, 615B, 615C Second recessed portion
AD Extension directions of axes
AFP Air flow path

The invention claimed is:

1. A headphone, comprising:

a casing that includes a hole portion leading to the inside and outside of the casing;

a diaphragm;

a support for supporting the diaphragm; and a plurality of air flow paths for air taken from the outside of the casing to the inside through the hole portion, wherein extension directions of axes set on open ends on one side of the plurality of air flow paths intersect, the support includes a plurality of arm portions in a direction from a center of the support towards an outer edge of the support, each arm portion has a configuration in which a support arm portion of the support is engaged with an engaging member, and each air flow path of the plurality of air flow paths is formed by a first recessed portion in the support arm portion and a second recessed portion in the engaging member.

2. The headphone according to claim 1, wherein the extension directions of the axes intersect at a substantially central position of the support.

3. The headphone according to claim 1, wherein the open ends on the one side of the plurality of air flow paths are on a pinna side with reference to the diaphragm.

4. The headphone according to claim 1, further comprising a microphone supported by the support, wherein the microphone is supported in the vicinity of a section where the extension directions of the axes intersect.

5. The headphone according to claim 4, wherein the support includes a microphone support portion that supports the microphone, and the microphone support portion includes a semi-closed space.

6. The headphone according to claim 1, wherein at least a part of a wall portion of each air flow path of the plurality of air flow paths is with a protrusion.

7. The headphone according to claim 1, wherein each air flow path of the plurality of air flow paths is with a porous body.

8. The headphone according to claim 1, wherein the open ends on the one side of the plurality of air flow paths are wide toward the open ends.

9. A headphone, comprising:

a casing that includes a hole portion leading to the inside and outside of the casing;

a diaphragm;

a support for supporting the diaphragm; and a plurality of air flow paths for air taken from the outside of the casing to the inside through the hole portion, wherein the plurality of air flow paths includes at least a pair of the air flow paths, open ends on one side of the respective air flow paths face each other, the support includes a plurality of arm portions in a direction from a center of the support towards an outer edge of the support, each arm portion has a configuration in which a support arm portion of the support is engaged with an engaging member, and each air flow path of the plurality of air flow paths is formed by a first recessed portion in the support arm portion and a second recessed portion in the engaging member.

10. The headphone according to claim 9, wherein the open ends on the one side of the air flow paths are arranged on a pinna side with reference to the diaphragm.

11. The headphone according to claim 9, wherein the support includes a microphone support portion that supports the microphone, and the microphone support portion includes a semi-closed space.

12. The headphone according to claim 9, wherein at least a part of a wall portion of each air flow path of the plurality of air flow paths is with a protrusion.

13. The headphone according to claim 9, wherein each air flow path of the plurality of air flow paths is with a porous body.

14. The headphone according to claim 9, wherein the open ends on the one side of the plurality of air flow paths are wide toward the open ends.

* * * * *